US006516888B1

(12) United States Patent
Gunnarson et al.

(10) Patent No.: US 6,516,888 B1
(45) Date of Patent: Feb. 11, 2003

(54) DEVICE AND METHOD FOR REGULATING FLUID FLOW IN A WELL

(75) Inventors: Bengt Gunnarson, Hundvåg (NO); Per Olav Haughom, Tonstad (NO)

(73) Assignee: Triangle Equipment AS, Stavanger (NO)

( * ) Notice: Subject to any disclaimer, the term of this patent is extended or adjusted under 35 U.S.C. 154(b) by 0 days.

(21) Appl. No.: 09/701,860

(22) PCT Filed: Jun. 1, 1999

(86) PCT No.: PCT/NO99/00174

§ 371 (c)(1),
(2), (4) Date: Feb. 21, 2001

(87) PCT Pub. No.: WO99/63234

PCT Pub. Date: Dec. 9, 1999

(30) Foreign Application Priority Data

Jun. 5, 1998 (NO) ..... 982609

(51) Int. Cl.[7] ..... E21B 34/10

(52) U.S. Cl. ..... 166/373; 166/375; 166/321; 251/62; 137/236.1

(58) Field of Search ..... 166/373, 375, 166/319, 321; 137/236.1, 613, 614.11; 251/62, 89.5

(56) References Cited

U.S. PATENT DOCUMENTS

| | | | | |
|---|---|---|---|---|
| 4,036,247 | A | 7/1977 | Baugh | 137/236 |
| 4,945,995 | A | 8/1990 | Tholance et al. | 166/375 |
| 5,547,029 | A | 8/1996 | Rubbo et al. | 166/375 |
| 6,338,466 | B1 * | 1/2002 | Wallace et al. | 251/62 |
| 2001/0006019 | A1 * | 7/2001 | Deininger et al. | 91/508 |

FOREIGN PATENT DOCUMENTS

| | | |
|---|---|---|
| WO | WO98/09055 | 3/1998 |

* cited by examiner

*Primary Examiner*—William Neuder
(74) *Attorney, Agent, or Firm*—Jacobson Holman PLLC

(57) ABSTRACT

A device for mutually independent control of regulating devices for controlling fluid flow between a hydrocarbon reservoir and a well includes a flow controller and a hydraulic actuator. The actuator is flow-relatedly arranged in series with at least two associated control valves in a path between two hydraulic pipes. The control valves are controlled to open for the flow of hydraulic liquid to the actuator by the pressure in the two hydraulic pipes, and the combination of two hydraulic pipes which are connected to an actuator is different for independently controllable regulating devices.

12 Claims, 6 Drawing Sheets

DEVICE AND METHOD FOR REGULATING FLUID FLOW IN A WELL

FIELD OF THE INVENTION

A device for mutually independent control of regulating devices for controlling fluid flow between a hydrocarbon reservoir and a well which extends from a starting area to the hydrocarbon reservoir, wherein the regulating devices are provided in the well in the hydrocarbon reservoir, where each regulating device comprises a flow controller with a regulating element which is movable between regulating positions for the fluid flow and is connected to an actuating element of a hydraulic actuator, the hydraulic actuator is provided with two hydraulic ports, the actuating element is movable between regulating positions upon a minimum pressure differential between the ports, the differential pressure being provided by hydraulic pipes which extend from the well's starting area to the hydrocarbon reservoir.

BACKGROUND OF THE INVENTION

In recovery of hydrocarbons from hydrocarbon reservoirs wells are drilled from a starting area, which may be the seabed or the surface of the earth, down to the reservoir. The wells are lined with casings to prevent the well from collapsing. The casing is perforated in the reservoir area, thus enabling hydrocarbons to flow into the well. Inside the casing a tubing is placed for conveying the hydrocarbon flow to the starting area.

The hydrocarbon reservoirs are located in isolated pockets, which may have a large horizontal area. In the case of such reservoirs the well is drilled vertically down from the surface, whereupon the well is directed horizontally into the reservoir.

The flow of hydrocarbons inside the casing causes the pressure to become higher towards the end of the well. This pressure differential is undesirable, since it can result in the penetration of water and gas into areas with low pressure, which may give rise to flow problems and reduced production from the well.

In order to control the inflow into the well along the length of the well, and to enable the well to be closed off in some areas, sliding or rotation sleeves are employed with flow openings which can be closed by a regulating element which is pushed in the well's longitudinal direction or rotated about the well's longitudinal axis.

The sleeves form an integral part of the casing/tubing. They are moved by electric or hydraulic motors, and are operated from the well's starting area by means of electric cables and/or coil tubing with hydrostatic pressure. The sleeves have to be capable of being controlled both towards an open and closed position, and therefore, when using direct hydraulic control, there must be two coil tubes for each sleeve. The number of sleeves can be large, 10 or more, and direct hydraulic control of each sleeve would therefore entail a large number of coil tubes. Thus the normal procedure is to use an electrohydraulic system where the energy for moving the sleeves' regulating elements is supplied hydraulically, and the control of the hydraulics is performed by electromechanical valves.

The well may have a depth of 2000 m, and a horizontal length of 3000 m, with the result that the length of the transfer cables and the coil tubes is formidable. On account of both the installation costs and operational problems, therefore, there is a desire to restrict the number of cables and coil tubes.

The pressure down in the well may be 200 to 300 bar, while the temperature may be between 90 and 180° C. In this environment regulating devices, and particularly electromechanical components, often become defective after short-term use. The economic consequences of not being able to control the inflow into the well are enormous, and consequently there is a desire to find devices for controlling the flow of hydrocarbons which are simpler and more reliable than the present devices, and it is particularly desirable to avoid electromechanical components in the reservoir area.

When water or gas are injected into a hydrocarbon reservoir, the water or gas in some places might flow directly to a production well, and consequently in the case of injection wells it is also desirable to be able to close or control the flow from the well to the reservoir in specific areas.

U.S. Pat. No. 4,945,995 describes a method and a device for mutually independent, hydraulic control of at least two devices, including flow regulating devices provided in production zones in a well. An object of the method and the device is to reduce the number of hydraulic interconnecting pipes required for the control. This is achieved with a combined electro-hydraulic solution.

WO-98/09055 describes a method and device for selective control of devices disposed down in a well. The control comprises electrical and hydraulic signal connections.

SUMMARY OF THE INVENTION

The object of the invention is to provide a device and a method for mutually independent control of regulating devices for controlling fluid flow between a hydrocarbon reservoir and a well which extends from a starting area to the hydrocarbon reservoir, which device and method will be simpler than known devices and methods, and where the components which are employed in the reservoir area will be robust and reliable. A further object is that the number of coil tubes and/or cables will be less than in the case of known devices and methods. Further objects will be apparent from the special part of the description. The objects are achieved according to the invention with a device and a method of the type mentioned in the introduction which are characterized by the features which are stated in the claims.

In the invention both energy and control signals are transferred to the regulating devices only by means of hydraulic pipes. Electric cables and electromechanical components are avoided in their entirety, thereby obtaining a simpler and more robust and reliable control of the fluid flow. Compared to the number of coil tubes/cables which are employed in the prior art, with the invention fewer hydraulic pipes can be employed for independent control of the same number of regulating devices, thereby achieving a simplification of the control. This will be further elucidated in the special part of the description.

BRIEF DESCRIPTION OF THE DRAWINGS

The invention will now be explained in more detail in connection with a description of a specific embodiment, and with reference to the drawings, in which.

DETAILED DESCRIPTION OF THE PREFERRED EMBODIMENTS

Figure 1:
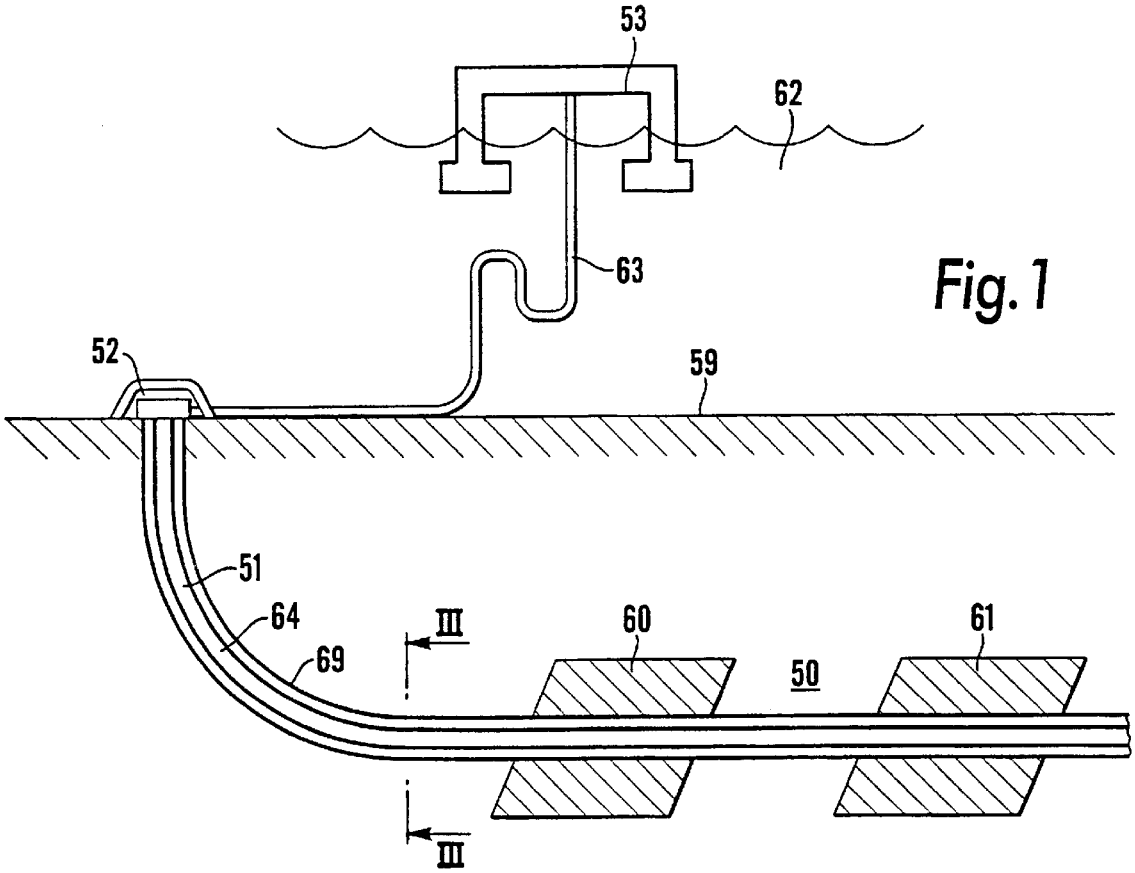
FIG. 1 illustrates a well for recovery of hydrocarbons offshore.

FIG. 1 illustrates a well 51 for recovery of hydrocarbons offshore. The well 51 is drilled from a seabed 59 to a substantially horizontal hydrocarbon reservoir 50. In a starting area on the seabed the well is connected via a wellhead 52 and a riser 63 to a floating platform 53 which is located in the sea 62. The well 50 is lined with a casing 69, and in the well there is inserted a tubing 64 for conveying hydrocarbons from the reservoir 50.

As mentioned in the general part of the description the reservoir may be located 2000 metres under the seabed, and the horizontal, hydrocarbon-producing part of the well may have a length of 3000 m. The well produces different amounts of hydrocarbons in different production zones, only two of which are illustrated with reference numerals 60 and 61. In order to control the production, regulating devices can be introduced in the production zones.

Figure 2:
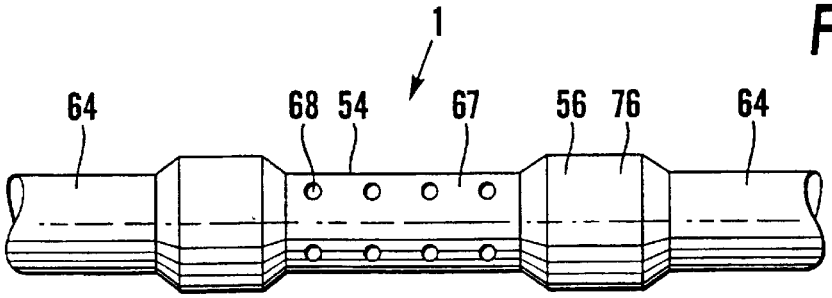
FIG. 2 illustrates a rotation sleeve for controlling the inflow to the well.

FIG. 2 illustrates a regulating device 1 which is inserted in the tubing 64 in a production zone for controlling the inflow into the well. The regulating device comprises a flow controller 54 in the form of a rotation sleeve 67 with flow openings 68 and an internal regulating element which is not illustrated in FIG. 2. The regulating device 1 also comprises an actuator 56 arranged in an actuator housing 76 for actuating the flow controller 54. In addition the regulating device comprises not shown control valves for controlling the flow of hydraulic liquid to the actuator 56. FIG. 2 should be understood in general terms, and applies both to prior art and the invention.

Figure 3:
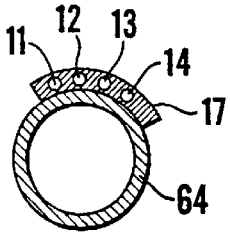
FIG. 3 illustrates a cross section through a tubing which is employed in the invention, taken along intersecting line III—III in FIG. 1.

FIG. 3 illustrates a cross section through a tubing which is employed in the invention, taken along intersecting line III—III in FIG. 1. Hydraulic pipes, here numbering four hydraulic pipes 11–14, are arranged on the outside of the tubing 64, inside a jacket 17. The hydraulic pipes 11–14 extend from the well's starting area, i.e. the wellhead 52, to the reservoir. The starting area may also be a wellhead on shore, or the hydraulic pipes may be conveyed to a platform or a production ship.

Figure 4:
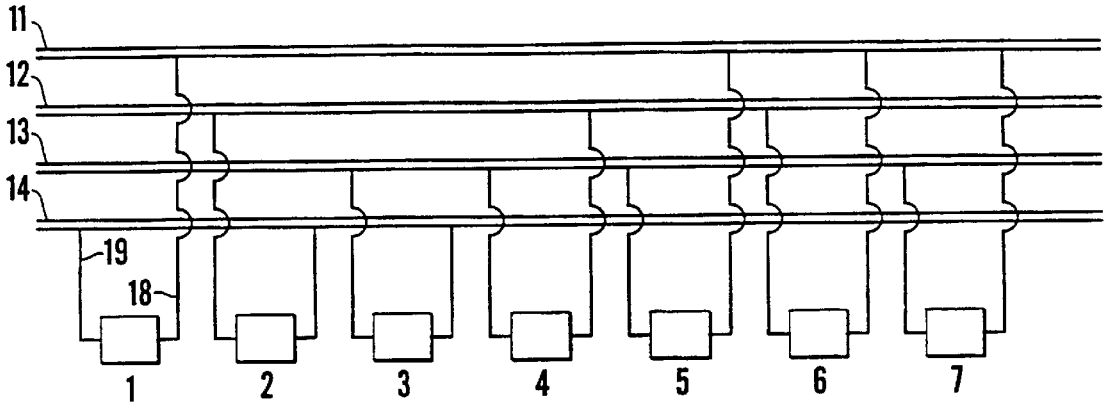
FIG. 4 illustrates the connection between hydraulic pipes and regulating devices which are employed in the invention.

FIG. 4 illustrates the connection between the hydraulic pipes 11–14 and the regulating devices 1–7 which are employed in the invention. The regulating devices are illustrated in schematic form, and as mentioned with reference to FIG. 2, each regulating device comprises a flow controller, an actuator for the flow controller, and control valves for controlling the flow of hydraulic liquid between the hydraulic pipes and the actuator.

The hydraulic pipes are connected in twos to each regulating device. It can be seen that the combination of two hydraulic pipes which are connected to the regulating devices is different for regulating devices 1–6, and that regulating device 7 is connected to the same hydraulic pipes as regulating device 5, viz. hydraulic pipes 11 and 13.

FIGS. 5–9 illustrate different arrangements of hydraulic control valves which can be employed in the invention. The invention is not limited to a specific number of hydraulic pipes, a specific number of regulating devices or a specific arrangement of control valves, and for ease of understanding of the presentation, only those control valves for the regulating device 1, which are connected to hydraulic pipes 11 and 14 are mentioned.

Figure 5:
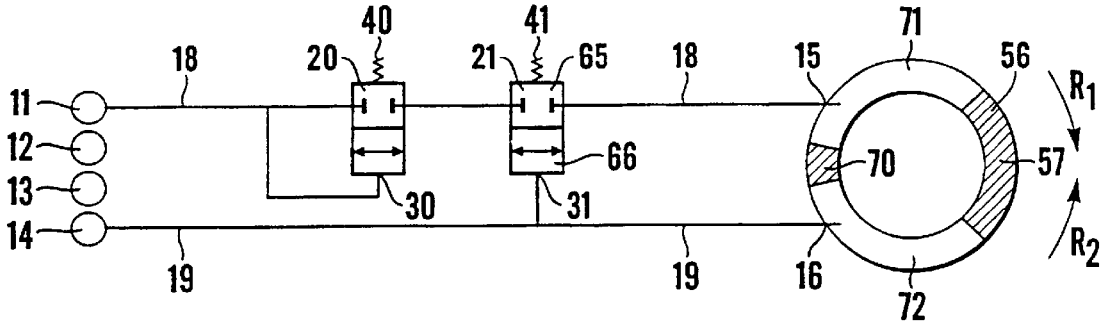
FIGS. 5–9 illustrate different arrangements of hydraulic control valves which can be employed in the invention.

FIG. 5 illustrates the four hydraulic pipes 11–14, a hydraulic actuator 56 and two control valves 20 and 21, which are located in a hydraulic path 18, 19 between the hydraulic pipes and the actuator. The actuator is illustrated in schematic form, and comprises a static portion 70 and a movable actuating element 57, both of which are in the form of segments of a circle, and are arranged in an annular space which is limited externally by a not shown circular actuator housing and is limited internally by a not shown circular inner wall which forms an extension of the tubing's wall. The static portion 70 and the actuating element 57 define a first and second hydraulic chamber 71 and 72 respectively with hydraulic ports 15 and 16 respectively.

The control valves 20 and 21 control the flow of hydraulic liquid between the actuator 56 and the hydraulic pipes, and are hydraulic control valves of the type which open and close for the flow of hydraulic liquid in the presence and absence respectively of at least an opening pressure on a control port 30 and 31 respectively.

The illustrated control valves are of the type pressure-controlled directional control valve with return spring which in the absence of pressure on the control port moves the valve to the closed position, and are illustrated schematically according to standardised rules. With reference to valve 21 the top square 65 illustrates an interrupted path through the valve, showing the valve in the closed position. The bottom square 66 illustrates a path which is open in both directions, showing the valve in the open position. Reference numeral 41 illustrates the return spring, i.e. a spring which moves the valve to its neutral position, which for these valves means the closed position, in the absence of pressure on the control port 31. According to standardised rules the valve 21 is illustrated connected to the path 18 in its neutral position. When at least an opening pressure is applied to the control port 31 the spring 41 is compressed, and the valve is moved to the open position. In FIGS. 5–9 the valves, the control ports and the return springs are indicated by reference numerals 20–25, 30–35 and 40–45 respectively, with the last figure identical for the same valve.

According to the invention, the actuator 56 is flow-relatedly arranged via the ports 15, 16 in series with at least two associated control valves in a hydraulic path between two hydraulic pipes. FIG. 5 illustrates the actuator 56 flow-relatedly arranged in series with control valves 20, 21 between two hydraulic pipes 11, 14, thus illustrating the least number of control valves which are necessary according to the invention.

According to the invention the control port on at least one of the control valves shall be connected to one of the hydraulic pipes, and the control port on at least one of the other control valves shall be connected to the other hydraulic pipe. In FIG. 5 the control port 30 on the control valve 20 is connected to hydraulic pipe 11 via the hydraulic path 18, and the control port 31 on the control valve 21 is connected to hydraulic pipe 14 via the hydraulic path 19, which is in accordance with the invention.

When the regulating device is controlled the two hydraulic pipes which are connected to the control valves for the regulating device's actuator are pressurised with hydraulic liquid to at least the associated control valves' opening pressure. This is done by pumping hydraulic liquid down into the hydraulic pipes from the well's starting area. With reference to FIG. 5 the regulating device 1 is controlled by pressurising the hydraulic pipes 11 an 14 to a pressure which is higher than the opening pressure for the control valves 20 and 21, typically 75 bar. The control valves 20 and 21 thereby open for the flow of hydraulic liquid in the paths 18 and 19, between the hydraulic pipes 11 and 14 and the actuator 56.

The first and second hydraulic chambers 71 and 72 respectively in the actuator 56 are thereby connected to the hydraulic pipes 11 and 14 respectively. The pressure is then increased in one of the hydraulic pipes 11 or 14, thus establishing a pressure differential between the ports 15, 16, i.e. between the first and second hydraulic chambers. When the pressure differential is sufficiently great to overcome the internal friction in the regulating device 1, the actuating element 57 is moved. The pressure in the hydraulic pipe which has highest pressure may be 200 bar, while the pressure in the hydraulic pipe which has lowest pressure may be at the opening pressure for the control valves or slightly higher. It will be seen that the actuating element 57 is moved in the direction $R_1$ when there is overpressure in the first chamber 71, and in the direction $R_2$ when there is overpressure in the second chamber 72. The actuating element 57 is connected to the regulating element in the flow controller, with the result that the establishment of the pressure differential between the hydraulic pipes causes an actuation of the flow controller in a direction which depends on the direction of the pressure differential.

Figure 6:
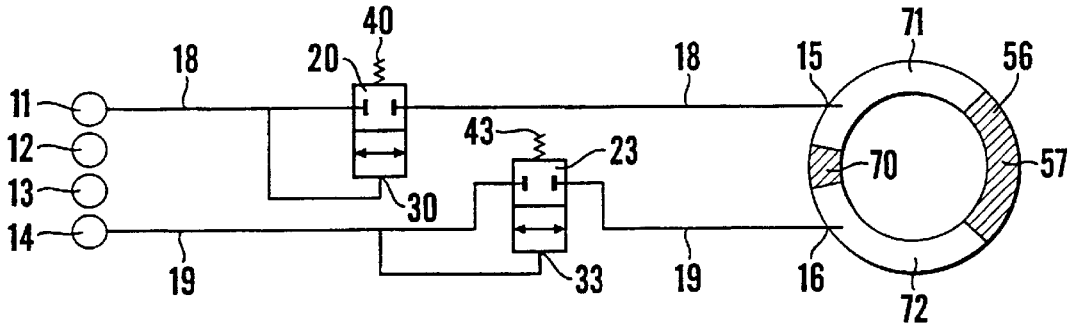

FIG. 6 illustrates a valve arrangement where a control valve 20 or 23 is flow-relatedly arranged on each side of the actuator 56. When the hydraulic pipes are pressurised this valve arrangement will function in the same way as the valve arrangement which is illustrated in FIG. 5. The valve arrangement in FIG. 6, however, may have operational advantages, as gas bubbles or impurities, for example, which may be present in the hydraulic pipe 14 when it is unpressurised, are stopped by the valve 23, thus preventing them from moving into the actuator 56.

Figure 7:
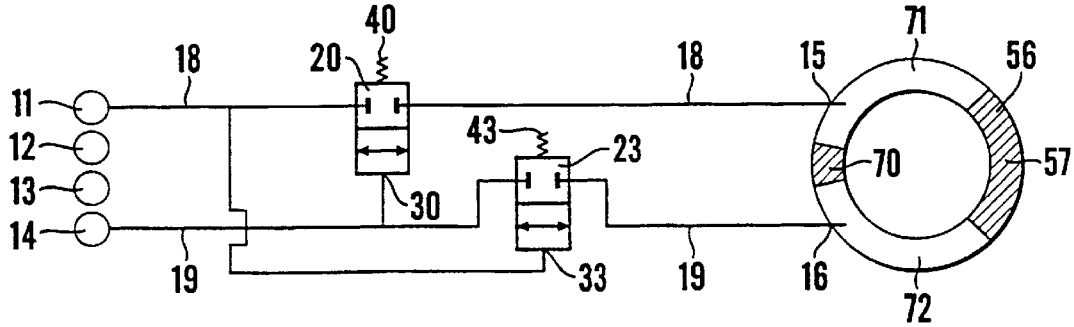

FIG. 7 illustrates an arrangement of the control valves corresponding to FIG. 6, with the difference that the control ports are connected to opposite hydraulic pipes. Compared to the valve arrangement in FIG. 6 this valve arrangement has the advantage that none of the chambers in the actuator 56 will be pressurised if only one of the hydraulic pipes is pressurised.

Under ideal hydraulic operating conditions, with completely controlled pressure and incompressible, gas-free hydraulic liquid, the valve arrangements in FIGS. 5–7 will offer complete control of the regulating device 1. In practice, however, the hydraulic pressures in the hydraulic pipes will vary over time, and gas may appear in the pipes, giving rise to a compressible hydraulic medium and difficulties in controlling the pressure completely. By pressurising only one of the hydraulic pipes to a pressure which is higher than the control valves' opening pressure, with these valve arrangements undesirable movements of the actuating element may arise.

Figure 8:
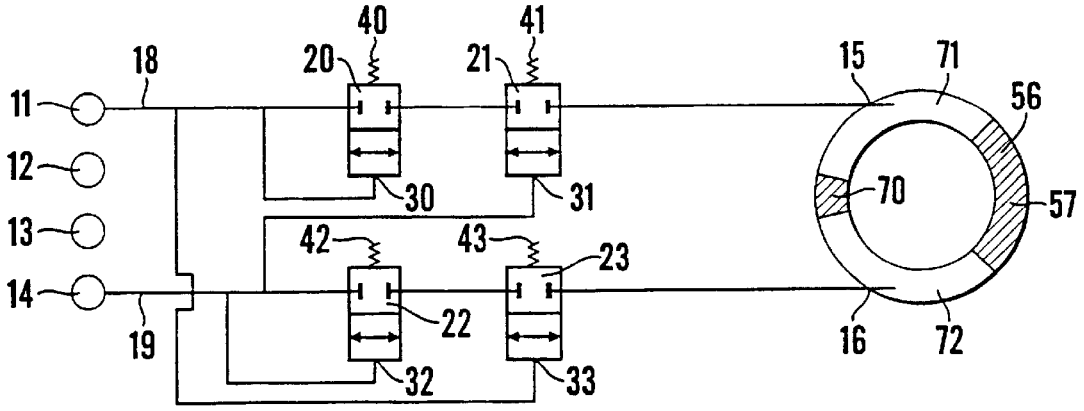

FIG. 8 illustrates a valve arrangement where on each side of the actuator 56 two control valves 20, 21 and 22, 23 respectively are flow-relatedly arranged, and where the two control valves which are located on the same side of the actuator have control ports, which is connected to a different hydraulic pipe, thereby illustrating that the control ports 30 and 33 are connected to hydraulic pipe 11, while the control ports 31 and 32 are connected to hydraulic pipe 14. In this valve arrangement both the chambers 71, 72 are shut off from connection with the hydraulic pipes until both the hydraulic pipes 11 and 14 are pressurised to a pressure which is higher than the control valves' opening pressure, thereby avoiding the above-mentioned potential problem with the valve arrangements illustrated in FIGS. 5–7.

Figure 9:
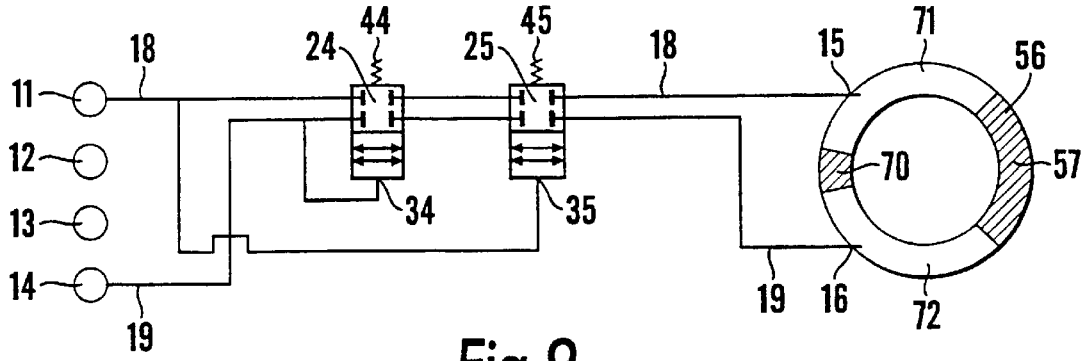

FIG. 9 illustrates a valve arrangement where two control valves, which are flow-relatedly located on each side of the actuator and which have control ports which are connected to the same hydraulic pipe, are composed of a control valve unit 24 or 25 with a common control port 34 and 35 respectively.

From the functional point of view the valve arrangement in FIG. 9 is identical with the valve arrangement in FIG. 8, since valve 24 can be understood as a combination of valves 21 and 22 and valve 25 can be understood as a combination of valves 20 and 23.

With reference to FIG. 4 it can be seen that when the hydraulic pipes 11 and 14 are pressurised to a pressure which is higher than the control valves' opening pressure, one of the hydraulic pipes is simultaneously pressurised in regulating devices 2, 3, 5, 6 and 7. With a valve arrangement as illustrated in FIG. 5 or 6, for regulating devices 2 and 3, which are both connected to hydraulic pipe 14, this will result in the pressurisation of the second chamber 72. The path 18 from the first chamber 71 is however closed, and under ideal operating conditions, as mentioned above, the pressurisation of the second chamber 72 will not result in any movement of the actuating element 57. However, as was also mentioned above, gas bubbles may occur or other factors may arise which cause movement in the actuating element. It should be obvious that this problem is less serious with a valve arrangement as illustrated in FIG. 7, and virtually eliminated with a valve arrangement as illustrated in FIGS. 8 and 9.

Figure 10:
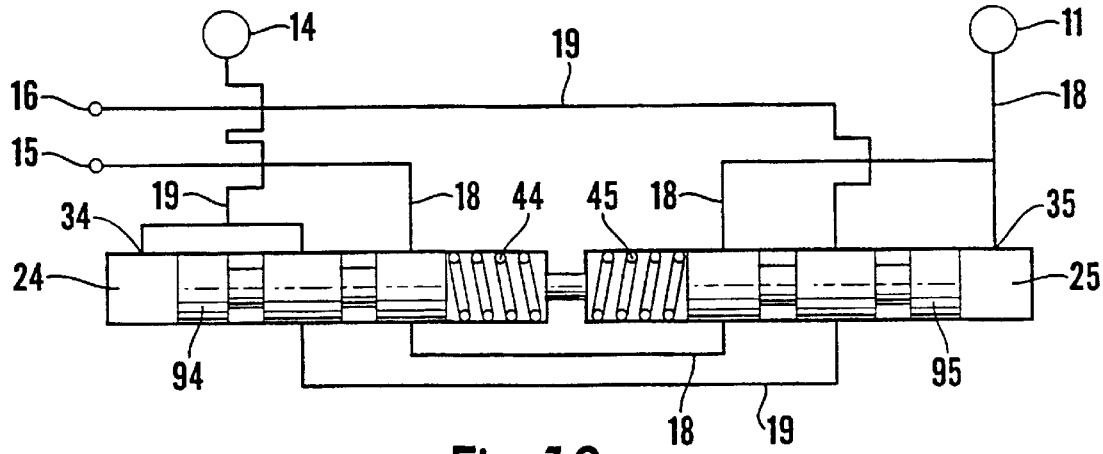
FIG. 10 illustrates a preferred hydraulic control valve according to the invention.

FIG. 10 illustrates an embodiment of the valve arrangement corresponding to the valve arrangement which is schematically illustrated in FIG. 9, with the difference that the paths 18, 19 in FIG. 9 go in the same direction, while those in FIG. 10 go in the opposite direction, which has no significance for the valves' function. The only reference numerals in FIG. 10 which are not shown in FIG. 9 are 94 and 95, which indicate a slide in valves 24 and 25 respectively. The valves 24, 25 are of a standard type, and a description of their function will therefore be omitted. It can be seen that valves 24 and 25 are mounted together in an oblong unit.

Figure 11:
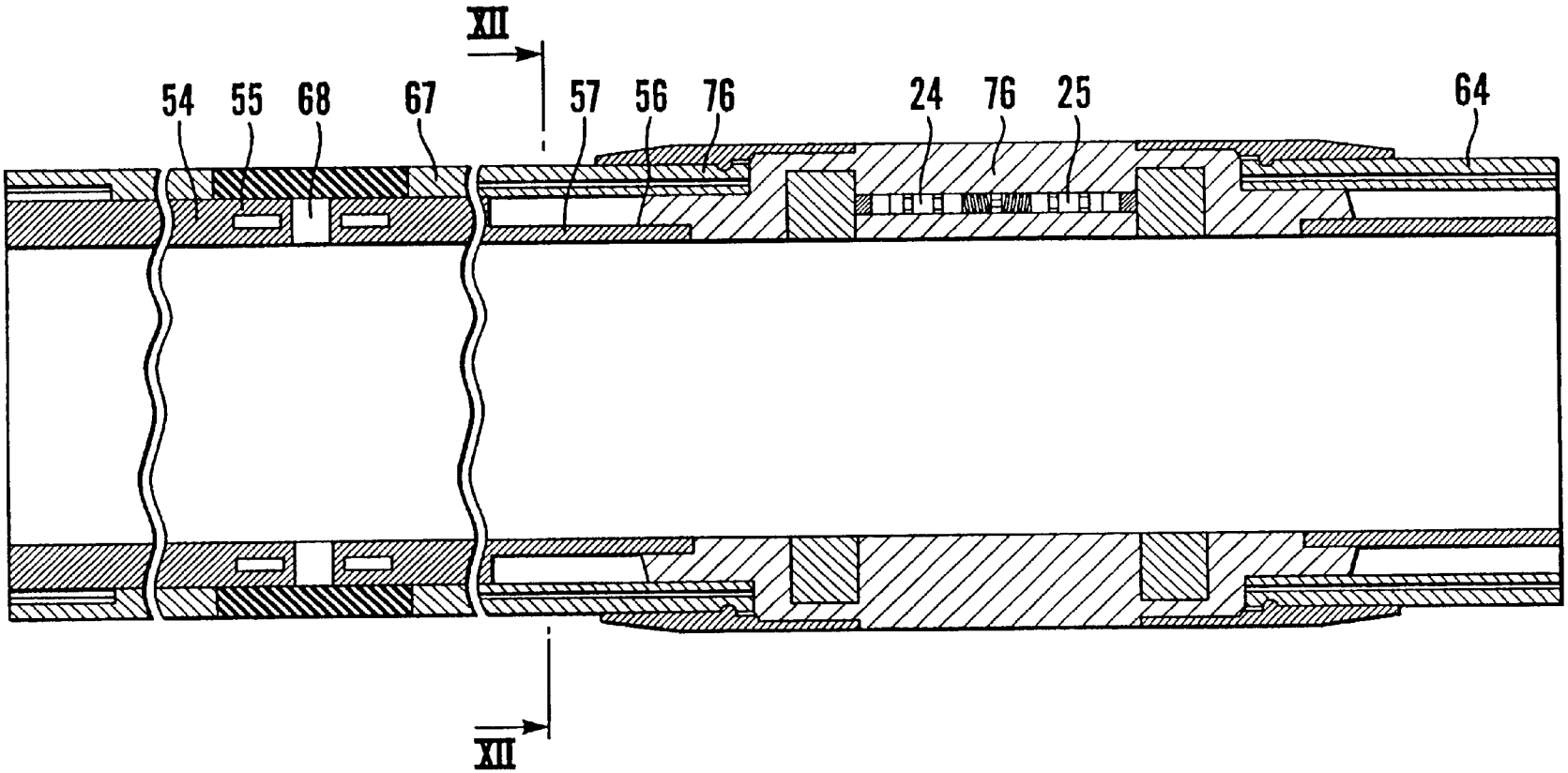
FIG. 11 illustrates a longitudinal section through a regulating device according to the invention.

FIG. 11 illustrates a longitudinal section through a regulating device according to the invention, in the form of a rotation sleeve 67, which is inserted in the tubing 64. The hydraulic pipes are not shown. The control valves 24 and 25 are designed as illustrated in FIG. 10, and arranged inside the wall of the actuator housing 76. Also illustrated are the actuator 56 with the actuator element 57, and the flow controller 54 with the flow openings 68 and the regulating element 55. The actuator element 57 is securely connected to the regulating element 55, thereby effecting a direct rotation thereof by means of rotation in the actuator 56 as a result of an applied hydraulic pressure differential.

The hydraulic paths 18 and 19 are not illustrated in FIG. 11. They are in the form of channels or passages in the actuator housing and other constructive components which form part of the regulating device, and which will not be described in detail.

Figure 12:
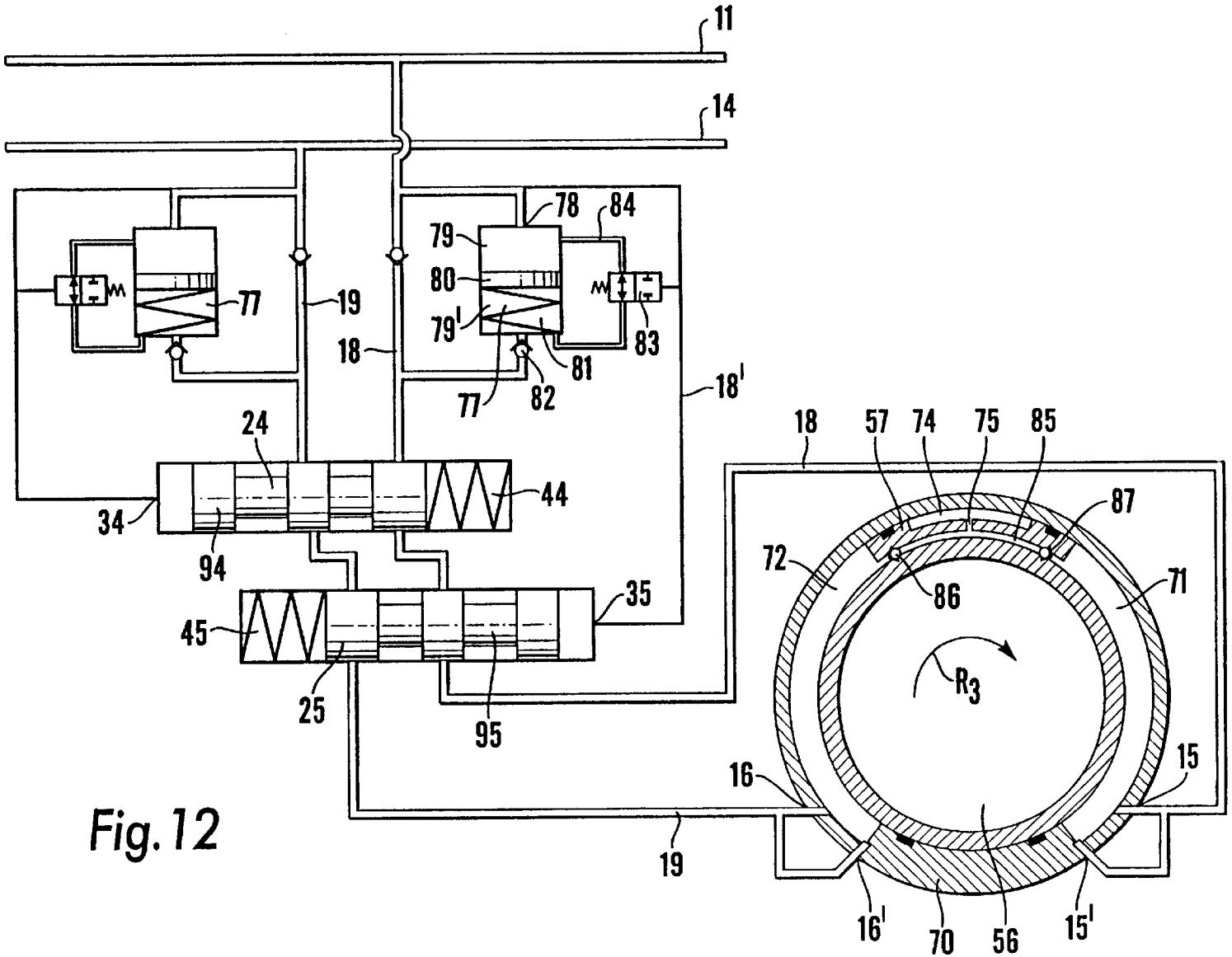

FIG. 12 illustrates a cross section through the actuator 56, taken along intersecting line XII—XII in FIG. 11, together with a schematic illustration of associated hydraulic paths and control valves. Reference should be made to FIGS. 5–10 for a general understanding of FIG. 12.

From the cross section through the actuator 56 it can be seen that the actuating element 57 and the static portion 70 define the first and second chambers 71 and 72 respectively. When there is a pressure differential between the ports 15 and 16 the actuating element is rotated depending on the direction of the pressure differential. It can be seen that the actuating element 57 is provided with an inner bypass chamber 85 which is closed off in end areas by check valves 86, 87, which only permit flow into the inner bypass chamber 85. Furthermore, the actuating element 57 has an outer bypass chamber 74 which is connected to the inner bypass chamber 85 through a bypass channel 75.

Figure 13:
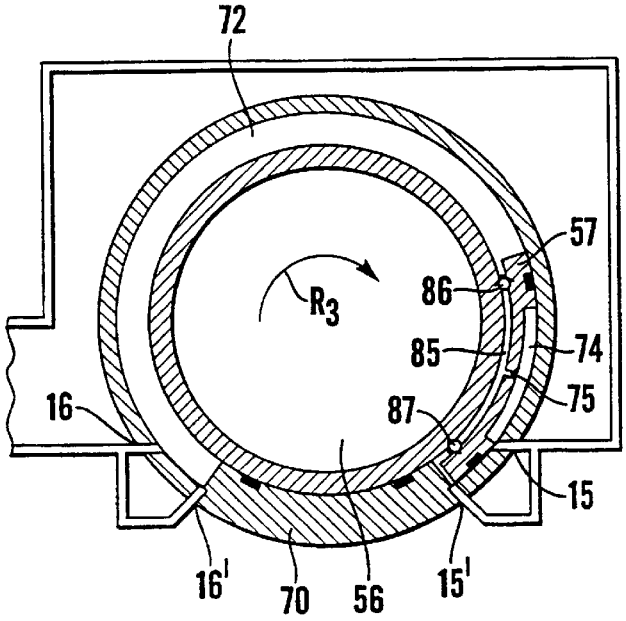
FIGS. 12–13 illustrates a cross sections through the regulating device, taken along intersecting line XII—XII in FIG. 11, together with hydraulic pipes and control valves.

Before a closer description of FIG. 12 reference should be made to FIG. 13, which illustrates the actuator 56 after the actuating element 57 is moved in the direction $R_3$ to an end position as a result of an applied pressure differential between the ports 15 and 16, the pressure being highest at port 16. It can be seen that in its end position the actuating element 57 closes the passage between the first chamber 71 and the port 15, while at the same time a passage is opened between the outer bypass chamber 74 and the port 15. A throughgoing passage is thereby opened from the second chamber 72, through the check valve 86, the inner bypass chamber 85, the bypass channel 75, the outer bypass chamber 74, to the port 15, and since hydraulic liquid which is located in the second chamber 72 has a higher pressure than at the port 15, hydraulic liquid will flow through the throughgoing passage.

By means of appropriate sizing of the throughgoing passage and the hydraulic system this throughput will result in a drop in the hydraulic liquid's pressure and/or an increase in the hydraulic liquid's flow rate. By monitoring the pressure in the two hydraulic pipes 11, 14 and the hydraulic liquid's flow rate during actuation, it is thereby possible to detect when the actuating element 57 and thereby the regulating element 55 has reached the end position.

By the application of overpressure to the port 15 relative to the port 16 the throughput of hydraulic liquid will stop, and the check valve 86 will close. It can be seen from FIG. 13 that an overpressure on the port 15 will not be capable of moving the actuating element 57, and an end port 15' which is connected to the port 15 is therefore arranged in close proximity to the static portion 70. The pressure is thereby transmitted to the port 15' and the hydraulic liquid presses against the end of the actuating element 57, thus causing it to move in the direction opposite $R_3$. By means of the actuating element's movement away from the end position the connection is broken between the port 15 and the outer bypass chamber 74, thus closing the throughgoing passage.

The actuating element's end position is one of several possible regulating positions, and it should be understood that corresponding throughgoing passages may be provided for other regulating positions.

The actuator's internal hydraulic volume, i.e. the total volume of the first and second chambers 71 and 72 respectively, will be a known size. Monitoring of the pressure in the two hydraulic pipes 11, 14 and the throughput volume of hydraulic liquid between the two hydraulic pipes 11, 14 during actuation, which can be implemented by a pressure measurement and a volumetric measurement at the well's starting area, thereby permits a calculation of the actuating element's 57 and thereby the regulating element's 55 regulating position after a lapse of time. The actuation begins when the pressure in the hydraulic pipes exceeds the control valves' opening pressure, and the throughput volume of hydraulic liquid during actuation must therefore be measured from this point in time.

In contrast to the embodiments illustrated in FIGS. 5–10, in the embodiment illustrated in FIG. 12, between the actuator 56 and each of the hydraulic pipes 11, 14 a self-controlled dosing valve 77 is flow-relatedly arranged in series with each control valve 24, 25. The dosing valve 77 is of the type in which an internal volume 79 is filled with inflowing liquid by pressurisation of the inlet 78, whereupon the inflow stops until the inlet 78 is depressurised. By means of repeated pressurisation of the inlet 78 the dosing valve 77 delivers the liquid of the internal volume 79, which is achieved as follows:

When there is overpressure on the inlet 78 hydraulic liquid flows into the internal volume 79, causing a piston 80 to compress a return spring 81. A bypass valve 83 is provided in a bypass 84 and controlled by the same pressure which influences the inlet 78. The bypass valve 83 is of the type pressure-controlled directional control valve with return spring, which in the absence of pressure on the control port moves the valve to the open position, the bypass valve 83 consequently closing the bypass 84 when the inlet 78 is pressurized. When the piston 80 is pushed down to the bottom of the dosing valve 77, the inflow of hydraulic liquid stops. At this point the pressure on the inlet 78 is relieved, which can be performed manually or automatically from the well's starting area, which depressurisation causes the bypass valve 83 to open for the flow of hydraulic liquid from the internal volume 79 above the piston, through the bypass 84, to the internal volume 79' below the piston. The return spring 81 pushes the piston 80 upwards, resulting in this flow of hydraulic liquid. At the same time a check valve 82 prevents hydraulic liquid from flowing into the dosing valve from downstream side. By means of repeated pressurisation of the inlet 78 new hydraulic liquid fills the internal volume 79, and the hydraulic liquid which is located in the internal volume 79' below the piston is forced out of the dosing valve 77. By counting the number of repeated pressurisations of the inlet 78, on the basis of knowledge concerning the internal volume 79 it is possible to calculate the throughput volume of hydraulic liquid more accurately than by a volumetric measurement at the well's starting area, thus achieving a more accurate determination of the actuating element's 57 and thereby the regulating element's 55 regulating position.

For a further description of the invention, reference should again be made to FIG. 4. As mentioned, the combination of two hydraulic pipes which are connected to a regulating device is different for the regulating devices 1–6. By pressurising hydraulic pipes 11 and 14 an independent control of the regulating device 1 is obtained. Similarly, by pressurising selected combinations of hydraulic pipes a mutually independent control of any of the regulating devices 1–6 can be obtained. The regulating device 7 is connected to the same hydraulic pipes as regulating device 5, these two regulating devices thereby having common control, and forming a regulating device group. Where there is a large number of regulating devices it is possible by this means to group the regulating devices in mutually independent regulating device groups.

It is also possible to perform a more complex control by pressurising several hydraulic pipes simultaneously, possibly to different pressure levels, with the result that the hydraulic pipe which is pressurised to the highest pressure for one regulating device represents the lowest pressure for another regulating device.

FIG. 4 shows how four hydraulic pipes offer the possibility of independent control of a maximum of 6 regulating devices. It further illustrates that with 3 hydraulic pipes it is possible to control 3 regulating devices independently of one another. Similarly, 5 hydraulic pipes offer the possibility of 10 independent regulating devices, 6 hydraulic pipes corresponding to 15 independent regulating devices, and so on. If the number of hydraulic pipes is designated n and the maximum number of independent regulating devices is designated N, it will be seen that N increases by n−1 when n increases by 1. It will further be seen that n=2 is the lowest possible value for n, and that in this case N is 1. Thus for n hydraulic pipes N is the total of a geometrical series where the first term is 1, the highest term n−1 and the number of terms n−1. From mathematical theory it is known that the total of a geometrical series is the total of the first and last terms multiplied by the number of terms in the series, divided by 2. This results therefore in $N=[(1+n-1)(n-1)]/2=n(n-1)/2$.

When a number of regulating devices are independently controlled according to the prior art, in the case of direct hydraulic control two hydraulic pipes must be employed for each regulating device. In the case of electromechanical control the number of hydraulic pipes can be limited to two, while two electric cables must be employed for each regulating device. With N regulating devices, therefore, at least 2N cables or coil tubes must be employed. In addition it is desirable to receive feedback from the reservoir concerning when the regulating elements have assumed specific regulating positions, which can be implemented with electrical limit switches, resulting in a further increase in the number of cables. It is possible, of course, to transfer signals with sophisticated electronics, thus reducing the number of electric cables, but this requires the use of electronic equipment in the reservoir area, which has been shown to be operationally unreliable on account of the pressure and particularly the temperature in the reservoir.

With the invention, therefore, the number of hydraulic pipes necessary for independent control of a given number of regulating devices is lower than the number of coil tubes/cables required in the prior art. From the formula for N it is seen that this advantage of the invention is relatively much greater for a large number of hydraulic pipes than for a small number. In order to achieve any substantial advantage with the invention the number of hydraulic pipes should be at least three.

From the above it should be obvious that the invention will also function for controlling the flow of fluid from a well to a reservoir. The invention can therefore also be used when injecting water or gas into a reservoir.

What is claimed is:

1. A device for mutually independent control of regulating devices for controlling fluid flow between a hydrocarbon reservoir and a well which extends from a starting area to the hydrocarbon reservoir, wherein the regulating devices are provided in the well in the hydrocarbon reservoir, where each regulating device comprises a flow controller with a regulating element which is movable between regulating positions for the fluid flow and is connected to an actuating element of a hydraulic actuator, the hydraulic actuator is provided with two hydraulic ports, the actuating element is movable between regulating positions upon a minimum pressure differential between the ports, the differential pressure being provided by hydraulic pipes which extend from the well's starting area to the hydrocarbon reservoir, comprising, for each regulating device, at least two control valves for controlling flow of hydraulic liquid between the ports of the actuator and the hydraulic pipes, the control valves open and close for the flow of hydraulic liquid in the presence and absence respectively of at least an opening pressure on a control port, wherein the actuator is flow-relatedly arranged via the ports in series with the control valves in a hydraulic path between two hydraulic pipes, and the control port on at least one of the control valves is connected to one of the hydraulic pipes, and the control port on at least one of the other control valves is connected to the other hydraulic pipe, and the combination of two hydraulic pipes which are connected to an actuator is different for independently controllable regulating devices.

2. The device according to claim 1, wherein there is flow-relatedly arranged at least one of said control valves on each side of each actuator.

3. The device according to claim 1, wherein there is flow-relatedly arranged two of said control valves on each side of each actuator, and that the two control valves have control ports each of which is connected to a respective hydraulic pipe.

4. The device according to claim 3, wherein two control valves which are flow-relatedly located on each side of the actuator and which have control ports which are connected to the same hydraulic pipe are composed of a control valve unit with a common control portion.

5. The device according to claim 1, wherein the actuator is provided with at least one throughgoing passage which is open for throughput of hydraulic liquid when the actuating element is located in regulating positions, and which is closed when the actuating element is located outside the regulating positions.

6. The device according to claim 1, wherein between each actuator and each of the hydraulic pipes to which the actuator is connected there is flow-relatedly arranged a self-controlled dosing valve in series with the control valves, and that the dosing valve is of the type in which an internal volume is filled with inflowing liquid on pressurisation of an inlet, whereupon the inflow stops until the inlet is depressurised, and which by means of repeated pressurisation of the inlet delivers the liquid of the internal volume.

7. A method for mutually independent control of regulating devices for controlling the fluid flow between a hydrocarbon reservoir and a well which extends from a starting area to the hydrocarbon reservoir, by means of a device, the method comprising: pressurizing two hydraulic pipes which are connected to control valves for an actuator of the regulating device with hydraulic liquid to at least an opening pressure of the control valves, opening the control valves for the flow of hydraulic liquid between the two hydraulic pipes and the actuator, and establishing a pressure differential between the two hydraulic pipes which is sufficiently great to move an actuating element, whereby the actuator actuates a flow controller.

8. The method according to claim 7, wherein the pressure in the two hydraulic pipes and the hydraulic liquid's flow rate are monitored during the actuation, and, since throughgoing passages are opened when the actuating element is located in regulating positions, the actuating element's and thereby a regulating element's regulating positions are detected as a drop in pressure of the hydraulic liquid and/or an increase in the hydraulic liquid's flow rate.

9. The method according to claim 8, wherein the pressure in the two hydraulic pipes and throughput volume of hydraulic liquid between the two hydraulic pipes are monitored during the actuation, and the regulating element's regulating positions are calculated on a basis of the actuator's internal hydraulic volume and throughput volume of hydraulic liquid during actuation.

10. The method according to claim 9, wherein the throughput volume of hydraulic liquid is calculated on a basis of dosing valve's internal volume and a number of pressurisations of an inlet.

11. The method according to claim 7, wherein the actuator is provided with at least one through going passage which is open for throughput of hydraulic liquid when the actuating element is located in regulating positions, and which is closed when the actuating element is located outside the regulating positions, the pressure in the two hydraulic pipes and the hydraulic liquid's flow rate are monitored during the actuation, and since the throughgoing passages are opened when the actuating element is located in regulating positions, the actuating element's and thereby the regulating element's regulating positions are detected as a drop in pressure of the hydraulic liquid and/or an increase in the hydraulic liquid's flow rate.

12. The method according to claim 7, wherein between each actuator and each of the hydraulic pipes to which the actuator is connected is flow-relatedly arranged a self-controlled dosing valve in series with the control valves, and the dosing valve has an internal volume filled with inflowing liquid on pressurisation of an inlet, whereupon the inflow stops until the inlet is depressurised, and which by repeated pressurisation of the inlet delivers the liquid of the internal volume, the throughput volume of hydraulic liquid is calculated on the basis of the dosing valve's internal volume and the number of pressurisations of the inlet.

* * * * *